US007703295B2

(12) United States Patent
Zangari et al.

(10) Patent No.: US 7,703,295 B2
(45) Date of Patent: Apr. 27, 2010

(54) MODULAR REFRIGERATION UNIT

(75) Inventors: Jony Zangari, O'Fallon, MO (US); Aaron Hernandez, St. Louis, MO (US); Javier Flores, San Nicolas de los Grarzo N.L. C.P. (PT); Raul Gutierrez, Tamps (MX); Dennis Dickerson, O'Fallon, MO (US)

(73) Assignee: Hussmann Corporation, Bridgeton, MO (US)

( * ) Notice: Subject to any disclaimer, the term of this patent is extended or adjusted under 35 U.S.C. 154(b) by 230 days.

(21) Appl. No.: 10/552,205

(22) PCT Filed: Apr. 7, 2004 (Under 37 CFR 1.47)

(86) PCT No.: PCT/US2004/010577

§ 371 (c)(1), (2), (4) Date: Oct. 6, 2005

(87) PCT Pub. No.: WO2004/092666

PCT Pub. Date: Oct. 28, 2004

(65) Prior Publication Data

US 2006/0196208 A1 Sep. 7, 2006

Related U.S. Application Data

(60) Provisional application No. 60/460,943, filed on Apr. 7, 2003.

(51) Int. Cl.
*F25D 19/00* (2006.01)

(52) U.S. Cl. ..... 62/298; 62/440

(58) Field of Classification Search ..... 62/298, 62/440, 448, 449, 450
See application file for complete search history.

(56) References Cited

U.S. PATENT DOCUMENTS

| | | | | |
|---|---|---|---|---|
| 3,230,733 | A | 1/1966 | Walling et al. | |
| 3,584,466 | A * | 6/1971 | Kaufman et al. | 62/183 |
| 3,712,078 | A * | 1/1973 | Maynard et al. | 62/448 |
| 4,462,460 | A * | 7/1984 | Braver | 165/207 |
| 5,417,081 | A | 5/1995 | Rudick et al. | |
| 6,799,818 | B2 * | 10/2004 | Ahmed et al. | 312/405.1 |

FOREIGN PATENT DOCUMENTS

| | | | |
|---|---|---|---|
| DE | 586747 | C | 10/1933 |
| DE | 586747 | C | 10/1933 |
| DE | 2319075 | A | 10/1973 |
| DE | 2319075 | A1 | 10/1973 |
| GB | 110378 | A | 10/1917 |
| GB | 110378 | A | 10/1917 |
| KR | 2006-566195 | * | 2/2006 |

* cited by examiner

*Primary Examiner*—Melvin Jones
(74) *Attorney, Agent, or Firm*—Michael Best & Friedrich LLP

(57) ABSTRACT

A modular refrigeration unit (12) for use in an accessible compartment (37) of a cooler. The modular refrigeration unit (12) includes a wire-frame support (50), a dividing wall (42) mounted to the wire-frame support (50), a condenser assembly (48) mounted to the wireframe support (50) on one side of the dividing wall (42), and an evaporator assembly (46) mounted to the opposite side of the dividing wall (42).

4 Claims, 9 Drawing Sheets

MODULAR REFRIGERATION UNIT

RELATED APPLICATIONS

This application is a 371 of PCT/US2004/010577 filed Apr. 7, 2004, which claims the benefit of U.S. Provisional Patent Application 60/460,943 filed Apr. 7, 2003.

FIELD OF THE INVENTION

This invention relates to a merchandising display cooler of the type used in convenience stores, snack bars and restaurants for storing and cooling drinks, particularly carbonated beverages provided in cans and bottles. More particularly, this invention relates to the refrigeration unit used for cooling the merchandiser and to the resultant air-flow distribution in the merchandiser.

BACKGROUND OF THE INVENTION

Typically, merchandising coolers have a vertical display area which is visible to the consumer through glass doors which may be hinged or which may slide for easy access to the display shelves positioned within the refrigerated compartment. The refrigerated compartment is cooled by a refrigeration unit that includes an evaporator assembly and a condenser assembly arranged in a closed circuit such that coolant (typically Freon) is pumped to the evaporator assembly by a compressor. The fan of the evaporator assembly distributes incoming return air from the refrigerated compartment to distribute the cooled air into the interior of the refrigerated compartment. The coolant is withdrawn from the evaporator coil in a gaseous state and pumped through a compressor to the condenser assembly to be condensed. After the coolant moves through the condenser assembly, it flows back to the evaporator to repeat the cycle.

Commonly, the condenser and evaporator assemblies are positioned separately and remotely from each other within the walls of the cooler. Most commonly the condenser assembly is located in the base of the cabinet and the evaporator assembly is located in the top of the cabinet. The origins of this arrangement are partly historical in that condensers and evaporators were often provided by respective suppliers who did not design their units to cooperate with each other. It thus became convenient to locate them separately and to complete the assembly after installation in the cabinet by providing appropriate electrical connecting means and tubular conduits for coolant flow between the condenser assembly and the evaporator assembly.

The "split. system" has inherent disadvantages which are apparent during assembly and servicing of the cooler cabinet. It will be appreciated that the assemblies cannot be tested until fully installed in the cabinet and that, if any problems are discovered, the entire cabinet must be accommodated so that it can at least be partially disassembled and retested. Similarly, when a cooler which has been in use is found to be defective, the entire cooler must be put out of service in order to carry out the appropriate repairs.

In order to overcome the previously-stated problems, the present invention provides a modular refrigeration unit that includes a condenser assembly and an evaporator assembly mounted on a common frame that is easily removable from the cooler for more efficient repair or replacement.

SUMMARY OF THE INVENTION

In accordance with one aspect of the invention, there is provided a modular refrigeration unit for use in an accessible compartment of a cooler. The modular refrigeration unit includes a wire-frame support, a dividing wall mounted to the wire-frame support, a condenser assembly mounted to the wire-frame support on one side of the dividing wall, and an evaporator assembly mounted to the opposite side of the dividing wall. The wire-frame support includes a forward portion that provides a convenient gripping location such that the modular refrigeration unit can be easily installed into and removed from the accessible compartment by an operator lifting and manipulating the modular refrigeration unit by the gripping location.

The dividing wall and a portion of the accessible compartment being adapted to sealingly engage with each other so as to define an insulated compartment for containing the evaporator assembly separate from the condenser assembly which remains within a portion of the accessible compartment that is in fluid communication with the atmosphere. The condenser assembly includes a compressor, a motorized fan, condenser coil, and collecting tray. The condenser assembly operates to receive the coolant from the evaporator assembly and return the coolant to the evaporator assembly in a condensed form. The evaporator assembly comprises an evaporator coil associated with a fan which directs warmer return air from the refrigerated cabinet over the evaporator coil so that the emerging cooled air is forced into the cabinet for distribution.

In accordance with another aspect of the invention, a back wall of the cabinet is spaced from an inner back panel which extends along the height of the interior of the cabinet. The space between the inner back panel and the back wall defining a vertically extending air passage for cold air flow. The cold air passage discharges cold air into the cabinet at selected locations defined by openings formed in the inner back panel. The cold air is discharged into the cabinet from the air passage and is directed toward the front of the cabinet, and then redirected down and around the forward portion of a lower plate of the cabinet. Once the return air bypasses the lower plate, it is redirected to a return air passage that is located in the interior floor.

Other features and advantages of the invention will become apparent to those skilled in the art upon review of the following detailed description, claims, and drawings.

Figure 1:
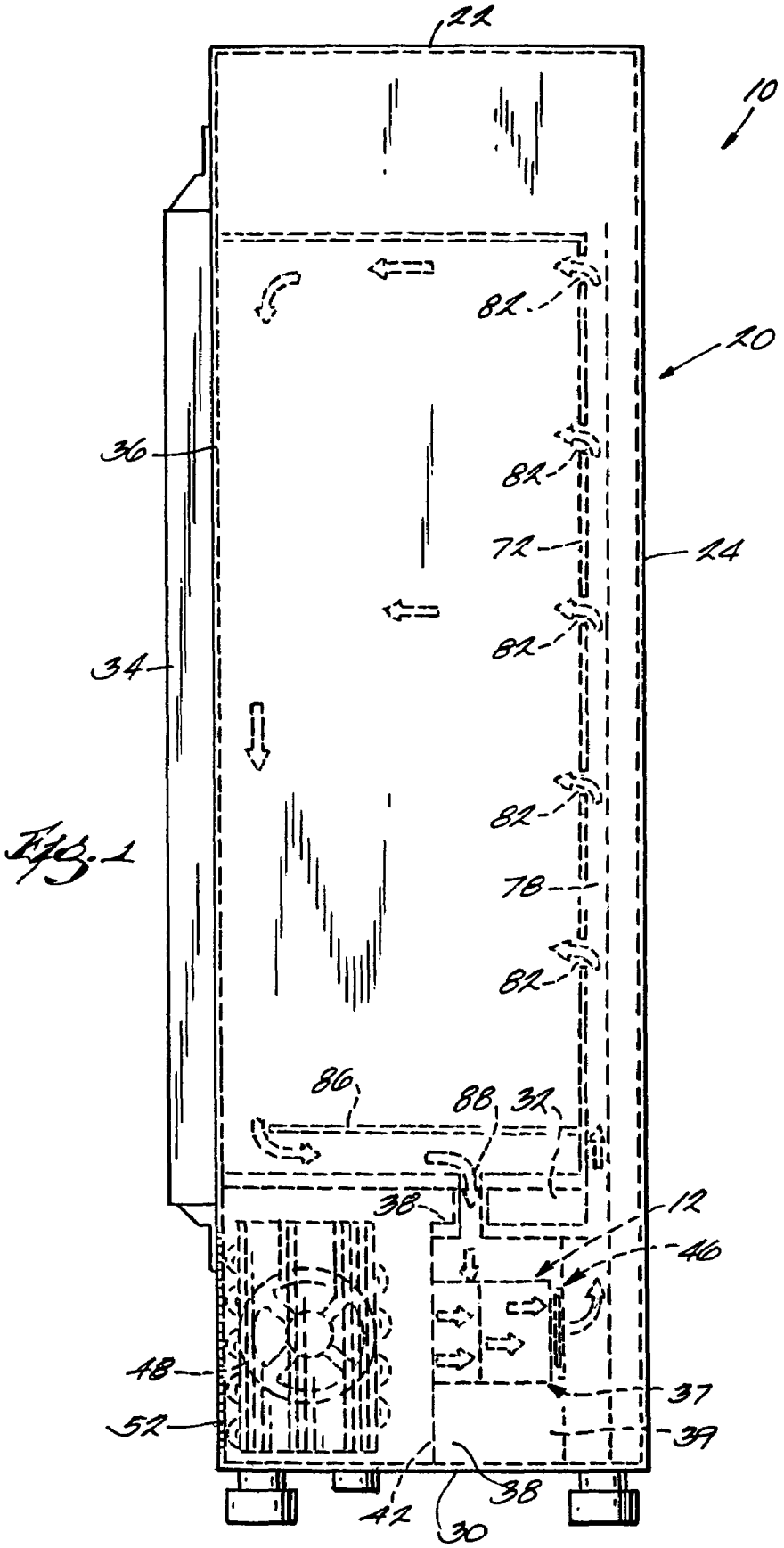
FIG. 1 is a side view of a merchandising display cooler according to an embodiment of the present invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items. The use of letters to identify elements of a method or process is simply for identification and is not meant to indicate that the elements should be performed in a particular order.

DETAILED DESCRIPTION

Figure 2:
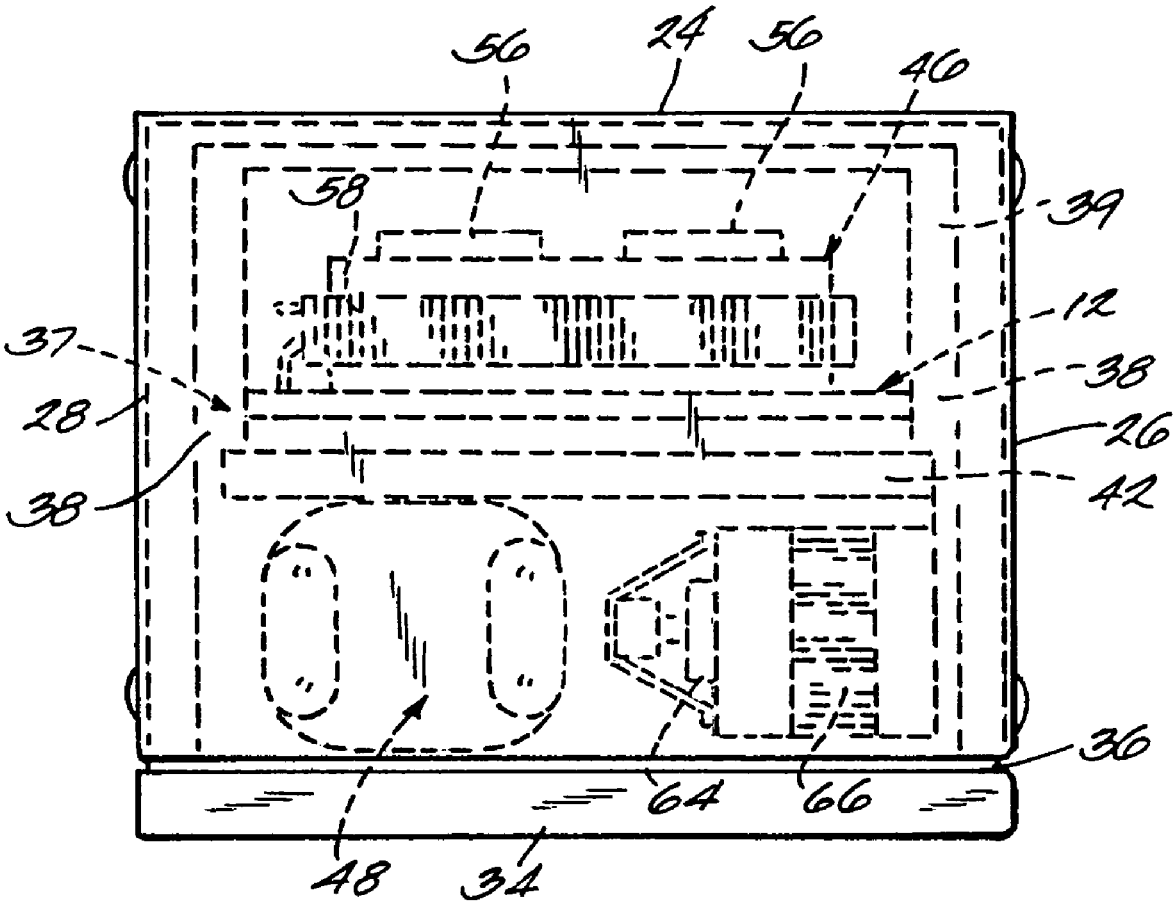
FIG. 2 is a top view of the merchandising display cooler shown in FIG. 1.

Referring to FIGS. 1 and 2, a merchandising display cooler 10 made in accordance with the invention comprises a cabinet generally indicated by numeral 20 having a top wall 22, back wall 24, right side wall 26, left side wall 28, and bottom wall 30. An insulated interior floor 32 is vertically spaced from the bottom wall 30 so as define an accessible compartment 37 accommodating a refrigeration unit 12. A transparent door 34 is hinged to one of the side walls 26, 28 and covers the front opening of the cabinet 20. A peripheral seal 36 mounted to the door 34 to keep the interior of the cabinet 20 airtight.

In the accessible compartment 37, the bottom wall 30, interior floor 32, and side walls 26, 28 each include a respective raised portion 38 that extends inwardly from the walls 26, 28, 30, 32. An insulated dividing wall 42 includes a peripheral seal 44 which sealingly engages the raised portions 38 within the accessible compartment.

The refrigeration unit 12 is comprised of an evaporator assembly 46 and a condenser assembly 48. The dividing wall 42 is mounted to a wire-frame support 50. The evaporator assembly 46 is mounted to one side of the dividing wall 42 so as to extend rearwardly towards the back wall 24 inside an insulated compartment 39. The condenser assembly 48 is mounted on the wire-frame support 50 on the opposite side of the dividing wall 42 such that the condenser assembly 48 extends forwardly of the dividing wall 42 towards the front of the accessible compartment 37. The condenser assembly 48 is thus accommodated beneath the forward portion of the interior floor 32. A cosmetically-pleasing, removable grill 52 is disposed beneath the door 34 and conceals the accessible compartment 37 and the modular refrigeration unit 12 from view.

Figure 6:
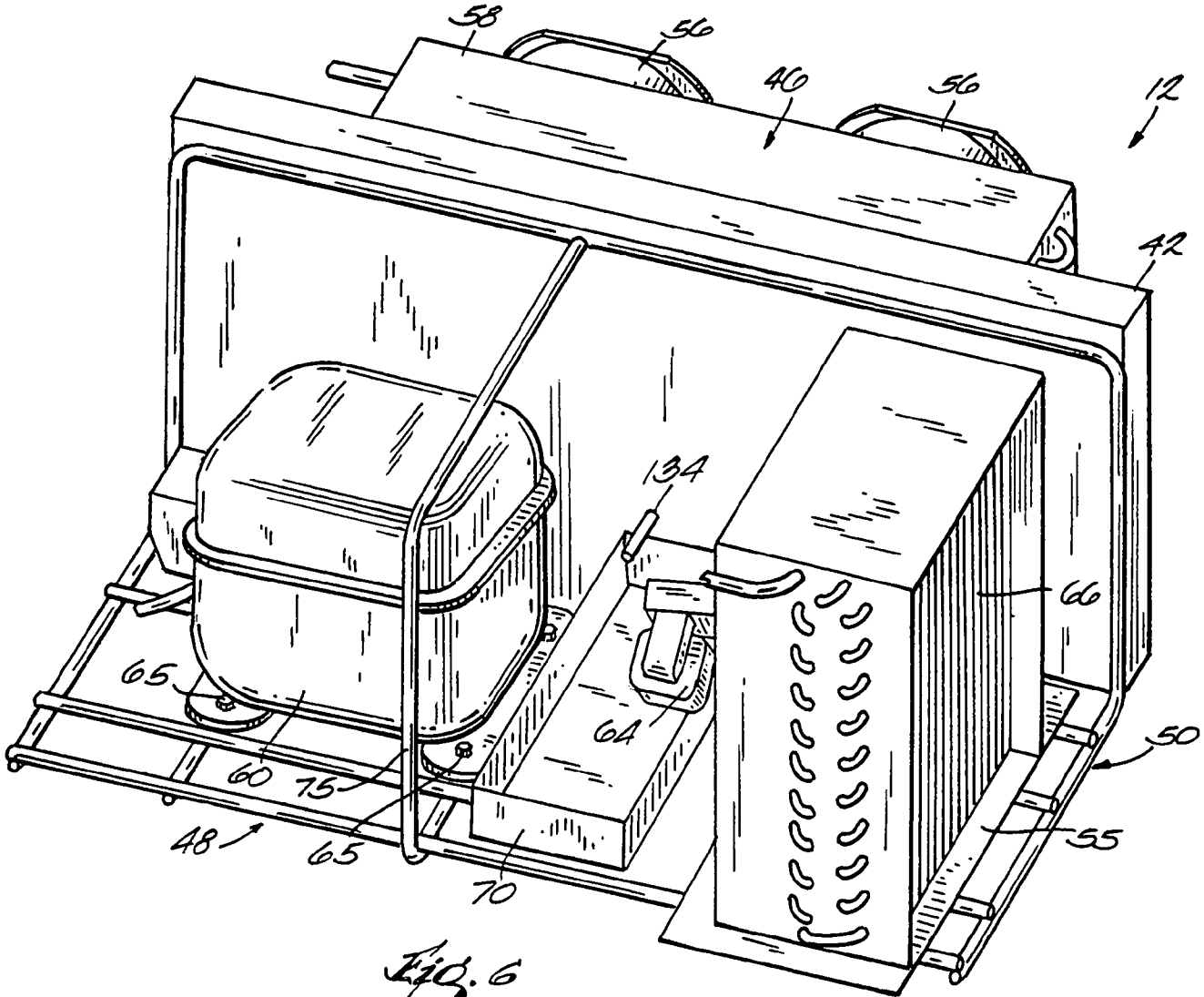
FIG. 6 is a front perspective view of the modular refrigeration unit shown in FIG. 3.
Figure 7:
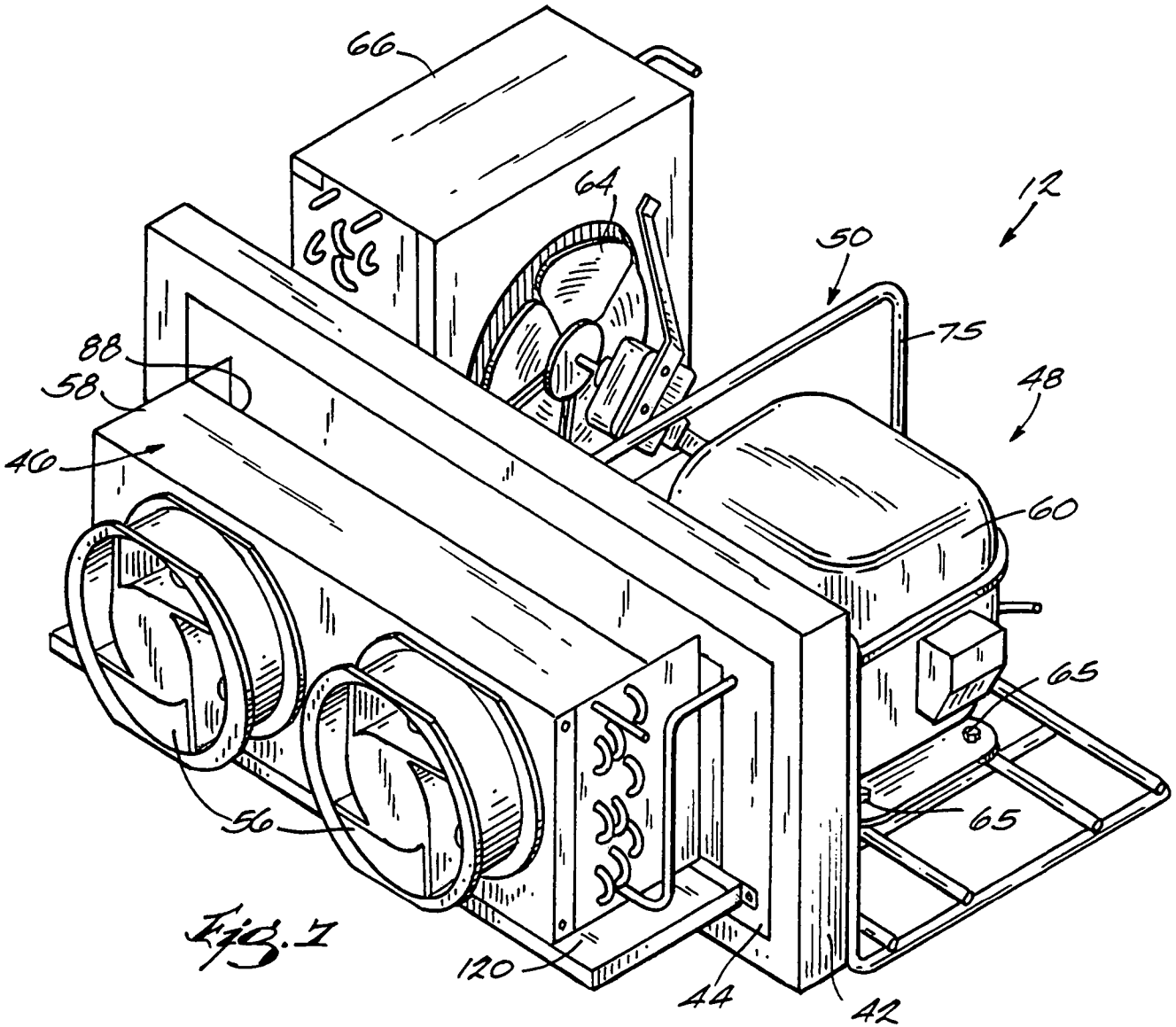
FIG. 7 is a rear perspective view of the modular refrigeration unit shown in FIG. 3.
Figure 8:
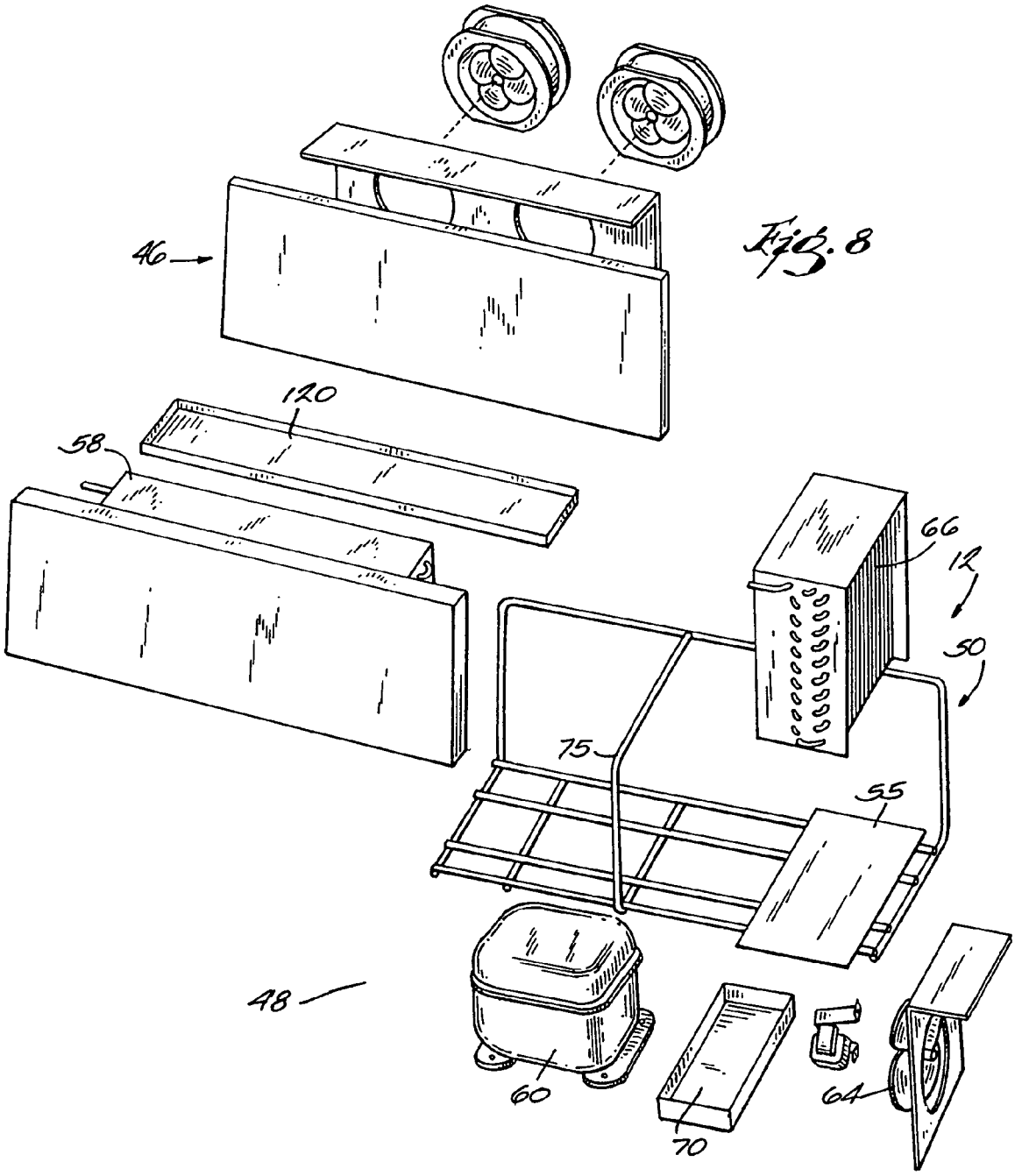
FIG. 8 is an exploded view of the modular refrigeration unit shown in FIG. 3.
Figure 9:
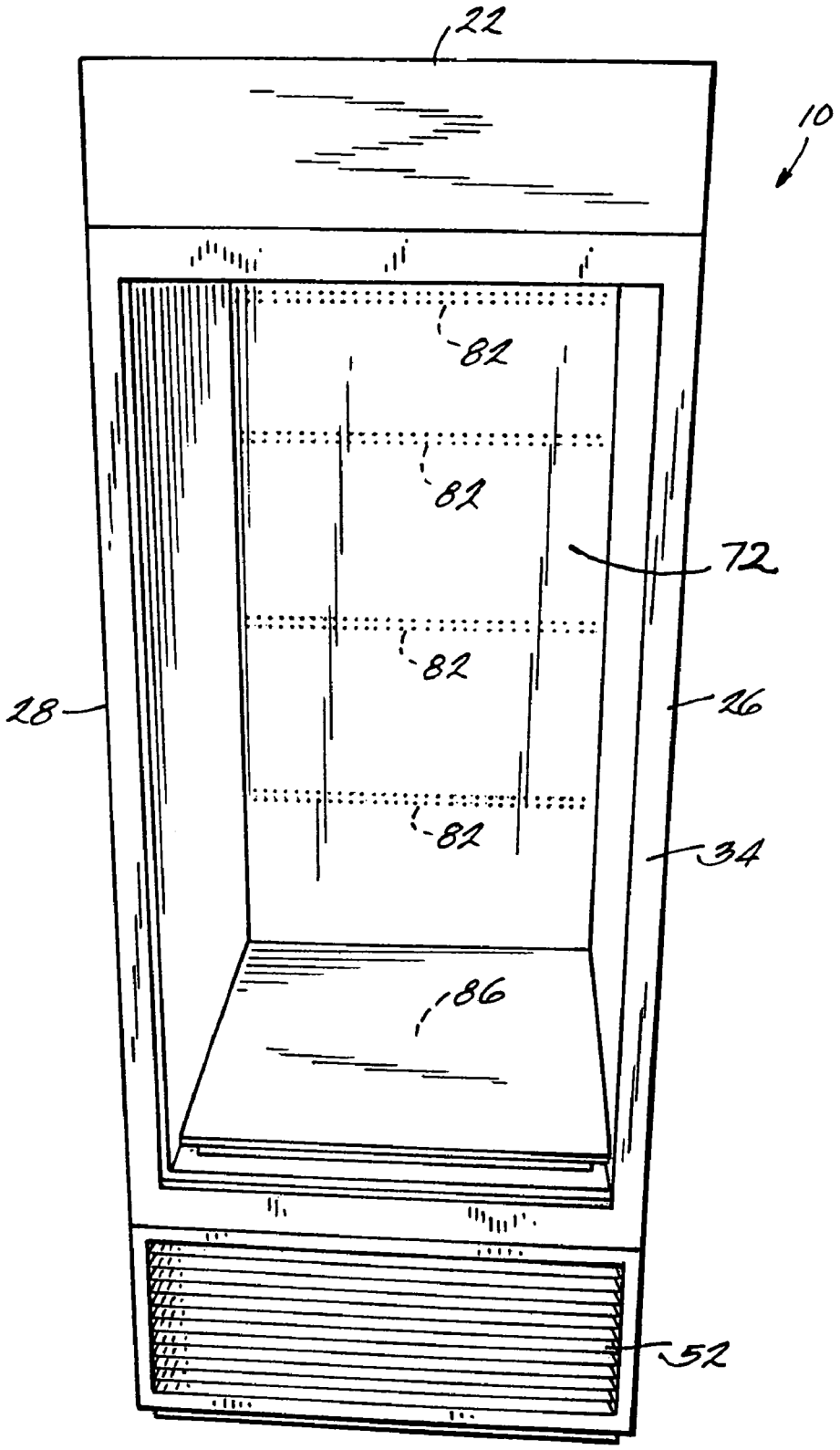
FIG. 9 is a front perspective view of the merchandising display cooler shown in FIG. 1.

The evaporator assembly 46 comprises an evaporator coil 58 mounted to the dividing wall 42. A motorized fan 56 is mounted to the evaporator coil 58 to move air through the evaporator coil 56 as is conventional in the art. As illustrated in FIGS. 6-8, multiple fans 56 can be used along with the evaporator coil 58. The condenser assembly 48 comprises a compressor 60, a motorized fan 64 and a heat exchanging condenser 66. The compressor 60 is mounted to the wire-frame support 50 through vibration damping mounts 65. The condenser 66 is mounted to the wire-frame support 50 through a support tray 55, and the fan 64 is mounted to the condenser 66.

Coolant is circulated in a closed circuit between the evaporator assembly 46 and the condenser assembly 48, leaving the evaporator coil 58 as a gas for compression in the compressor 60. The coolant is fed from the compressor 60 in a serpentine path through a coil that supplies the heat exchanging condenser 66 where the coolant is ultimately condensed to a liquid and returned to the evaporator assembly 46.

The interior floor 32 is spaced from the back wall 24 and an inner back panel 72 extends along the height of the interior of the cabinet from the interior floor 32 towards the top wall 22. The space between the inner back panel 72 and the back wall 24 defines a cold air passage 78. The evaporator assembly 46 is disposed inside the cabinet 20 so that cool air emerging from the evaporator coil 58 will enter the cold air passage 78. The inner back panel 72 includes openings 82 which discharge the flow of cold air from the cold air passage into the refrigerated compartment.

The return air passage 88 is defined in the interior floor 32 and is in communication with the insulated compartment of the evaporator assembly 46. Return air passage 88 receives warmed air from the refrigerated compartment and the fan 56 draws that air through the evaporator coils to cool the air and discharge it once again into the cold air passageway.

In use, cool air emerging from the evaporator assembly is forced into the cold air passage 78 and is discharged through the openings 82 into the refrigerated portion of the cabinet 20. There is sufficient pressure in the emerging cool air for at least some of this air to reach the front of the cabinet adjacent the door 34. The return air flows towards the interior floor 32 along the door 34. The air flows rearwardly along the interior floor 32 and below an interior plate 86 where it enters the return air passage 88 and is aspired by the evaporator fan 56 into the insulated compartment 39 containing the evaporator assembly 46.

Thus a circulatory air flow is created with cool air rising along the back wall, being discharged forwardly into the refrigerated compartment and returned on the interior floor 32 where it is returned to the evaporator assembly 46 so as to repeat the cycle. The openings 82 deliver cool air directly to the bottom rear zone of the refrigerated compartment and afford better temperature control in that area.

It will be appreciated that the evaporator assembly 46 is enclosed by the insulated compartment 39 defined by the insulated interior floor 32, the bottom wall 30, the insulated dividing wall 42, the insulated back wall 24 and the side walls 26, 28. By virtue of its function, the evaporator coil 58 is very cold and inevitably any moisture carried by return air aspired through the return air passages 88 is condensed when it reaches the insulated aforementioned compartment for the evaporator assembly 46. Effectively, the evaporator coil 58 operates to dehumidify the air in the refrigerated portion of the merchandising cooler.

An evaporator pan 120 is mounted to the wire-frame support 56 and is positioned under the evaporator coil 58. The pan 120 is shaped to collect any condensed moisture dripping from the evaporator coil 58. A drain hole is formed into the evaporator pan 120 and is connected to a drain conduit 134; The drain conduit 134 extends through the dividing wall 42 to discharge the collected moisture into a removable collection tray 70.

Figure 3:
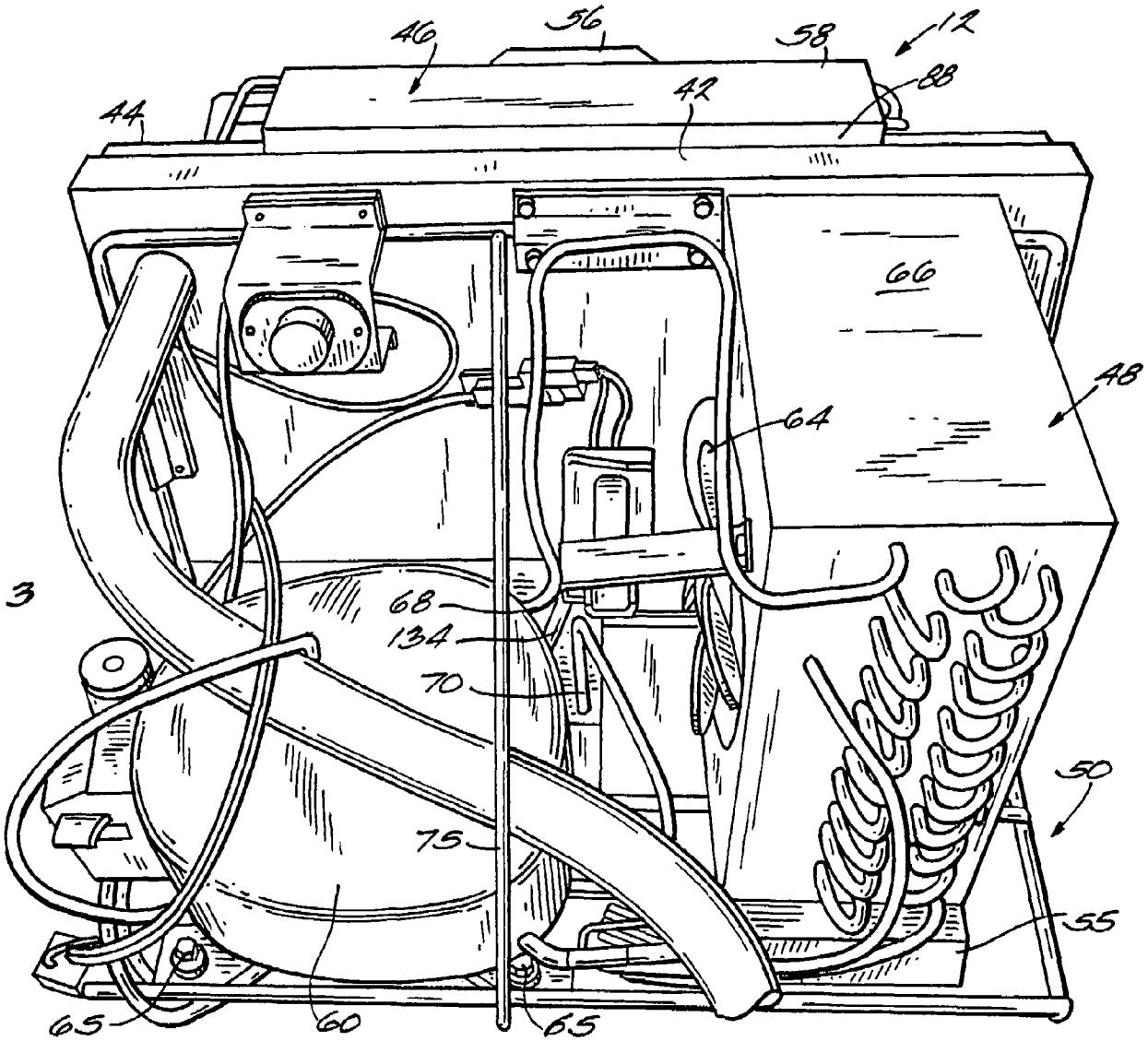
FIG. 3 is a front perspective view of a modular refrigeration unit of the merchandising display cooler shown in FIG. 1.
Figure 4:
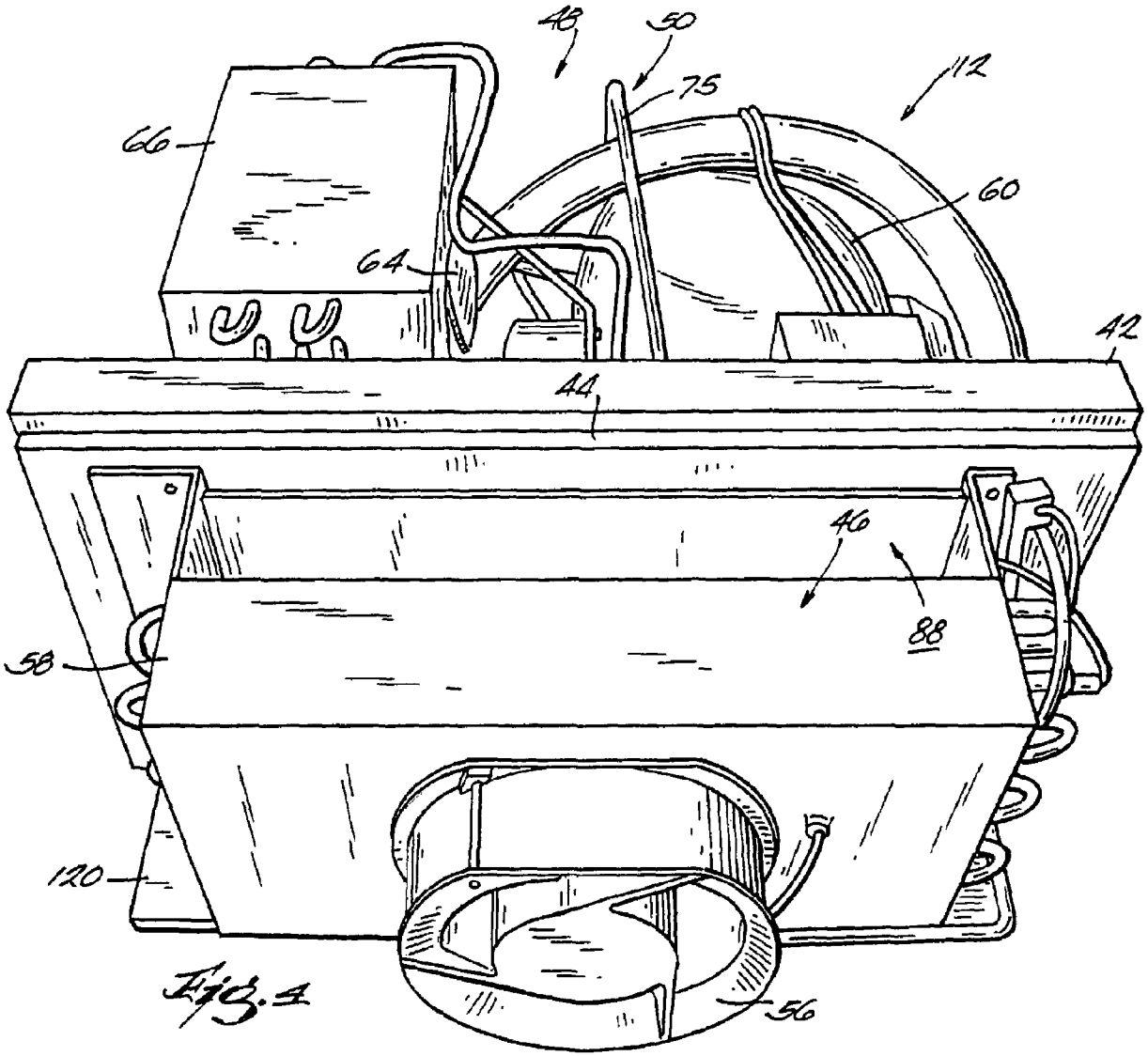
FIG. 4 is a rear perspective view of the modular refrigeration unit shown in FIG. 3.
Figure 5:
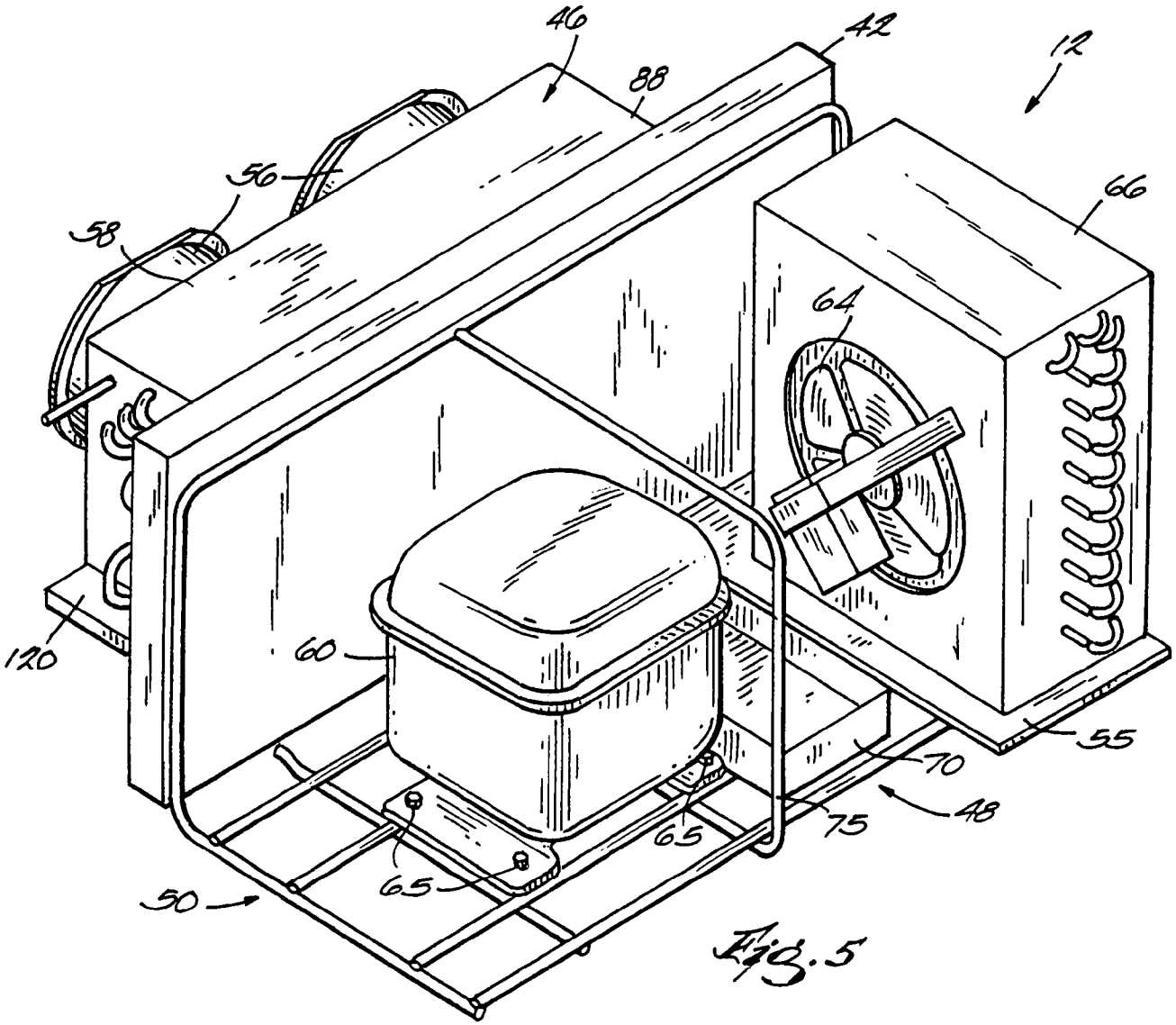
FIG. 5 is a front perspective view of the modular refrigeration unit shown in FIG. 3.

Condensed moisture emerging from the evaporator assembly 46 and fed through the drain conduit 134 thus collects in the collecting tray 70 and can be used to define a pre-cooling stage so as to assist in cooling gaseous coolant in the serpentine coil 68 (See FIG. 3) emerging from the compressor 60 prior to entry into the heat exchanging condenser 66. Conversely, hot coolant flowing through the condenser coil 68 will assist in evaporating any condensed moisture collected in the collecting tray 70. Liquids and condensed water vapor from the refrigerated interior of the cabinet can also be drained into the collecting tray 70. Evaporation of the liquids collected in the collecting tray 70 is further assisted by an ambient air flow as air is aspired by the fan 64 through the grill 52, adjacent the right side wall 26, and over the heat exchanging condenser 66 to exit from the condenser assembly 48 through the grill 52 adjacent the left side wall 28.

It will be understood that several variations may be made to the above-described embodiment of the invention. In particular, it will be understood that the nature of the refrigeration assembly as defined by the evaporator assembly 46 and the condenser assembly 48 may vary considerably. The relative proportions of the central cold air passage and the return air passages may vary, as well as the location of the cold air outlets and return air outlets provided in the inner back panel 72 in accordance with the particular application for which the cabinet is being used. Other variations within the scope of the appended claims may be apparent to those skilled in the art, the structure defined for cold air passages and warm air passages being inherently flexible to create a cooling environment adapted for any selected application.

The modular refrigeration unit 12 can be easily removed from the accessible compartment 37 by removing the grill 52 and sliding the unit 12 from the accessible compartment 37. The wire-frame support 50 includes a forward gripping portion 75 that provides the operator with a convenient gripping surface for moving the unit 12 into or out of the accessible compartment 37. The forward gripping portion 75 is a substantially vertical member that is positioned forwardly of the condenser assembly 48. The gripping portion could also be oriented differently and could also be recessed within the condenser assembly, however it is preferable for the forward gripping portion to be accessible from the front of the unit 12. Simple plug and socket type connections can be made to connect the unit 12 to a power source and a temperature sensor in the refrigerated compartment. The plug and socket connections can be easily disconnected prior to removal and easily connected after installation.

During operation of coolers in the field, it is not uncommon for a refrigeration unit to need replacement or repair. Typically, a serviceperson is called, and the serviceperson is required to travel to the location of the cooler to examine the refrigeration unit. If major repairs are necessary, the serviceperson may not be able to repair the unit on location which could lead to the cooler being inoperable for an extended period of time. The present invention allows easy replacement of a damaged unit with an operable unit without the assistance of a serviceperson allowing store operators to self-service their own coolers. When a store operator determines that the unit needs repair or replacement, the store operator can request a replacement unit from an authorized replacement location. A replacement unit will be sent to the store operator via overnight courier or the like, and when received by the store-operator, the store operator can independently exchange the replacement unit for the old unit. The replaced unit can then be shipped back to a designated location by the store operator in the same packaging that the replacement unit was shipped. The returned unit can then be refurbished and repaired for reuse. This type of replacement program could be offered to store operators as part of an insurance program offered with the sale of the cooler.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described herein are further intended to explain best modes known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

The invention claimed is:

1. A modular refrigeration unit for use in an accessible compartment of a cooler, the accessible compartment including a first portion in communication with a display cabinet of the cooler and a second portion in communication with an environment adjacent the cooler, the modular refrigeration unit comprising:

a wire-frame support removably positioned within the accessible compartment;

a dividing wall mounted to the wire-frame support, the divider wall being positioned between the first and second portions;

a condenser assembly mounted to the wire-frame support on one side of the dividing wall, the condenser assembly positioned within the second portion of the accessible compartment; and an evaporator assembly including an evaporator coil mounted to the opposite side of the dividing wall and a fan mounted to the evaporator coil, the evaporator assembly positioned within the first portion of the accessible compartment such that the evaporator coil is in communication with the display cabinet.

2. The modular refrigeration unit of claim 1, wherein the wire-frame support includes a forward portion that provides a gripping location for installing the modular refrigeration unit into the accessible compartment and removing the modular refrigeration unit from the accessible compartment.

3. The modular refrigeration unit of claim 1, wherein the condenser assembly includes a compressor mounted to the wire-frame support, a condenser coil mounted to the wire-frame support, a motorized fan mounted to the condenser coil, and a collecting tray mounted to the wire-frame support, the condenser coil in communication with the environment.

4. The modular refrigeration unit of claim 3, wherein the compressor is mounted to the wire-frame support with damping mounts.

* * * * *